US006663208B2

(12) United States Patent
Suzuki et al.

(10) Patent No.: US 6,663,208 B2
(45) Date of Patent: Dec. 16, 2003

(54) CONTROLLER FOR INKJET APPARATUS

(75) Inventors: Shigeru Suzuki, Nagoya (JP); Masatomo Kojima, Ichinomiya (JP); Akira Iriguchi, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/987,392

(22) Filed: Nov. 14, 2001

(65) Prior Publication Data

US 2002/0089558 A1 Jul. 11, 2002

(30) Foreign Application Priority Data

Nov. 22, 2000 (JP) ..... 2000-355866
Feb. 14, 2001 (JP) ..... 2001-036659

(51) Int. Cl.[7] ..... B41J 29/38
(52) U.S. Cl. ..... 347/10; 347/11; 347/9
(58) Field of Search ..... 347/9, 10, 11, 347/19, 23, 57, 94, 184

(56) References Cited

U.S. PATENT DOCUMENTS 5,600,349 A * 2/1997 Keefe ..... 347/11
6,283,568 B1 * 9/2001 Horii et al. ..... 347/10
6,293,639 B1 * 9/2001 Isamoto ..... 347/10
6,431,674 B2 * 8/2002 Suzuki et al. ..... 347/10

* cited by examiner

*Primary Examiner*—Benjamin R. Fuller
*Assistant Examiner*—Lam S Nguyen
(74) *Attorney, Agent, or Firm*—Oliff & Berridge, PLC

(57) ABSTRACT

An ink-jet head controller generates drive waveforms selectively at predetermined print cycles to cause ink ejection from a cavity. A waveform generator generates a plurality of waveform signals, including a waveform signal extending over two adjacent print cycles, and a waveform selector selects and outputs to the ink-jet head one of a plurality of waveform signals, based on whether dot data for two adjacent print cycles indicates ink ejection. The waveform selector selects a waveform signal extending over two adjacent print cycles when dot data for a current print cycle indicates ink ejection while dot data for a next print cycle indicates no ink ejection. In addition, a plurality of drive pulses cause ejection of a plurality of ink droplets to form a dot outputted after a certain delay from the start of the current print cycle.

14 Claims, 12 Drawing Sheets

CONTROLLER FOR INKJET APPARATUS

BACKGROUND OF THE INVENTION

1. Field of Invention

This invention relates to a controller for an ink-jet apparatus and, more particularly, to a controller for a piezoelectric type ink-jet apparatus.

2. Description of Related Art

Ink-jet type recording devices are well known in the prior art, and typically used for recording image data outputted from personal computers, facsimile machines, and the like. This type of recording device is superior to other types of recording devices in that it is quiet and capable of recording on sheets of various materials.

FIG. 1 is an exploded perspective view of part of an ink-jet head. Illustrated is the basic construction of an ink-jet head used for a piezoelectric type ink-jet printer. The ink-jet head is formed by stacking a cavity plate 10, a piezoelectric actuator 20, and a flexible flat cable 30 in this order from the bottom. The ink-jet head is provided with cavities 16, a supply hole 19, for supplying ink to the ink-jet head, and surface electrodes 26, 27 electrically connected to piezoelectric elements 50, which will be described later. The cavity plate 10 is formed by stacking five plates.

FIGS. 2A–2C and 3A–3C are vertical cross-sectional views of the ink-jet head taken along a direction perpendicular to its longitudinal direction when the cavity plate 10 and the piezoelectric actuator 20 are stacked upside down relative to the state shown in FIG. 1. As shown in FIG. 2A, the cavity plate 10 is formed by stacking five plates, namely, a nozzle plate 34, a first plate 36*a*, a second plate 36*b*, a third plate 36*c*, and a fourth plate 36*d*. A manifold 44, a restrictor orifice 46, a cavity 16, and a communication passage 48 are formed in corresponding plates 36*a*–36*d*. A nozzle 32 is formed in the nozzle plate 34 and ink in the communication passage 48 is ejected therethrough. The manifold 44 communicates with the supply hole 19 through a passage (not shown). In the ink-jet head, 75 sets of cavities 16 and nozzles 32 are arrayed in a row and another 75 sets of cavities and nozzles, which are bilaterally symmetrical with those shown in FIGS. 2A–2C, are arrayed in a row. A total of 150 sets of cavities and nozzles are arrayed in two rows such that 150 nozzles are aligned in a row. The piezoelectric actuator 20 is provided with a plurality of piezoelectric elements 50, which are placed adjacent to the cavities 16.

In a state shown in FIG. 2B, a voltage is applied to the piezoelectric element 50 to expand the piezoelectric element 50. When the application of a voltage to the piezoelectric element 50 is stopped, the piezoelectric element 50 contracts, as shown in FIG. 2C, and a negative pressure is developed in the cavity 16. Then, ink flows from the manifold 44 to the cavity 16. Upon reapplication of a voltage to the piezoelectric element 50, it expands again, as shown in FIG. 3A, and the ink that has flowed in is pressurized and ejected as a main ink droplet I from the nozzle 32. The above-described operation is repeated a specified number of times, according to a drive waveform supplied from a control circuit to the ink-jet head, to form a dot having the desired density. In short, a plurality of drive pulses are supplied to the ink-jet head in order to form a dot having the desired density.

When two drive pulses are supplied, the second pulse is supplied with such timing as to increase the residual pressure wave vibration in the cavity 16 generated by the first pulse. As a result, the second ink droplet is efficiently ejected.

In this case, however, an extra droplet called a satellite droplet S may be generated in addition to the main ink droplet I, as shown in FIG. 3B. This may occur when a plurality of droplets are continuously ejected to form a dot. If the pressure wave vibration in the cavity 16 is not reduced sufficiently after the main droplet I has been ejected, such residual pressure wave vibration will cause ejection of extra ink in the form of a satellite droplet. If this occurs, a finished printout may be undesirably altered. This may be especially so if a satellite droplet is ejected when no dot is formed next to the currently formed dot while using the same nozzle 22. In this event the satellite droplet can be seriously noticeable. Even if such a satellite droplet is not formed, formation of the next dot may become unstable due to the pressure wave vibration. To prevent generation of such an extra ink droplet, a cancel pulse (stabilizing pulse) is conventionally added. For example, when two pulses are supplied as described above, a cancel pulse is supplied following the second drive pulse with such timing as to cancel the residual pressure wave vibration in the cavity 16. In another conventional method, a first cancel pulse is supplied following the first drive pulse to cancel the residual pressure wave vibration, and a second cancel pulse is also supplied following the second drive pulse.

FIG. 4 shows a timing chart showing generation of a drive waveform having a cancel pulse. Upon generation of a strobe signal that regulates operation of the ink-jet head, dot data including the dot density is inputted to the control circuit of the ink-jet head. Then, the control circuit determines a drive waveform based on the received dot data and clock signals that regulate pulse generation.

A cancel pulse is especially important when no ink is ejected at a print cycle for the next dot. More specifically, when ink is ejected at a print cycle for the next dot, the next ink ejection will be less affected by the residual pressure wave vibration even if it is not attenuated sufficiently. However, when no ink is ejected at a print cycle for the next dot, the above-described satellite droplet will be generated by the residual pressure wave vibration, if it is not attenuated sufficiently.

Whether ink is ejected at each print cycle is determined based on the dot data stored in an image memory.

When the control circuit determines that the current dot data indicates ink ejection and the next dot data indicates no ink ejection, the control circuit selects a drive waveform having a cancel pulse CP to form the current dot. When the piezoelectric element 50 is driven according to the drive waveform having a cancel pulse CP, the pressure wave vibration in the cavity 16 is stabilized, thereby preventing generation of a satellite droplet S or unstable ink ejection, as shown in FIG. 3C. Although, in FIG. 4, a cancel pulse PC is inserted at the end of a drive waveform, it may be inserted in the middle of a drive waveform, or a plurality of cancel pulses may be inserted within a single drive waveform. In the above-described techniques, however, the length of a drive waveform is elongated because a cancel pulse is inserted into an original drive waveform required just for forming a dot. Setting the print cycle based on the elongated drive waveform will reduce the operating speed of the ink-jet head.

Another problem with the case where a plurality of drive pulses are supplied to the ink-jet head to form a dot is that when ink is ejected continuously over two print cycles to form two dots, the time interval between the last drive pulse for the first dot and the first drive pulse for the second dot may become short, depending on the number of drive pulses.

As a result, the residual pressure wave vibration in the cavity may not be attenuated in such a short time interval, resulting in unstable ink ejection for the second dot.

SUMMARY OF THE INVENTION

It is an object of this invention to provide an improved controller for an ink-jet apparatus that can perform high-speed printing and can perform stable ink ejection when ink is ejected continuously over two print cycles.

One aspect of the invention involves a controller for an ink-jet apparatus. The controller includes an ink-jet head that ejects ink from a cavity and a waveform generator that generates a plurality of waveform signals. The waveform signals are issued at predetermined print cycles to the ink-jet head, which forms dots sequentially, according to the plurality of waveform signals, on a print medium while moving relative to the print medium. A waveform selector selects one of the plurality of waveform signals based on whether dot data indicates ink ejection for the two adjacent print cycles. The waveform selector then outputs a selected waveform signal to the ink-jet head.

The waveform generator generates a plurality of waveform signals including a waveform signal extending over two adjacent print cycles. The waveform selector selects the waveform signal extending over two adjacent print cycles when the dot data for a current print cycle indicates ink ejection and the dot data for a next print cycle indicates no ink ejection.

Accordingly, when a dot is formed by ink ejection at the current print cycle, followed by no ink ejection at the next print cycle, the controller generates a waveform signal extending over two adjacent print cycles. Thus, high-speed printing can be achieved without elongating the print cycle.

According to another aspect of the invention, an ink-jet apparatus sequentially forms dots on a print medium by moving relative to the print medium and includes: a cavity plate having a cavity from which an ink droplet is ejected; an actuator that changes the pressure in the cavity; and a controller that outputs drive pulses, at predetermined print cycles, to the actuator based on dot data. When dot data for a current print cycle indicates ink ejection, while dot data for a next print cycle indicates no ink ejection, the controller continuously outputs a plurality of drive pulses to the actuator to cause ejection of a plurality of ink droplets from the cavity to form a dot. This occurs after a certain delay from a start of the current print cycle.

Accordingly, when a plurality of drive pulses have been continuously outputted at the previous print cycle, the time interval between the last drive pulse at the previous print cycle and the first drive pulse to be outputted at the current print cycle becomes longer than that obtained under conventional control. During such a long interval, the residual pressure wave in the cavity generated by the drive pulses outputted at the previous print cycle can be reliably attenuated, and ink ejection can be stably performed by drive pulses outputted at the current print cycle.

BRIEF DESCRIPTION OF THE DRAWINGS

The invention will be described with reference to the following figures in which like elements are labeled with like numbers and in which.

DETAILED DESCRIPTION OF PREFERRED EMBODIMENTS

A first embodiment of the invention will be described with reference to the accompanying drawings.

Figure 1:
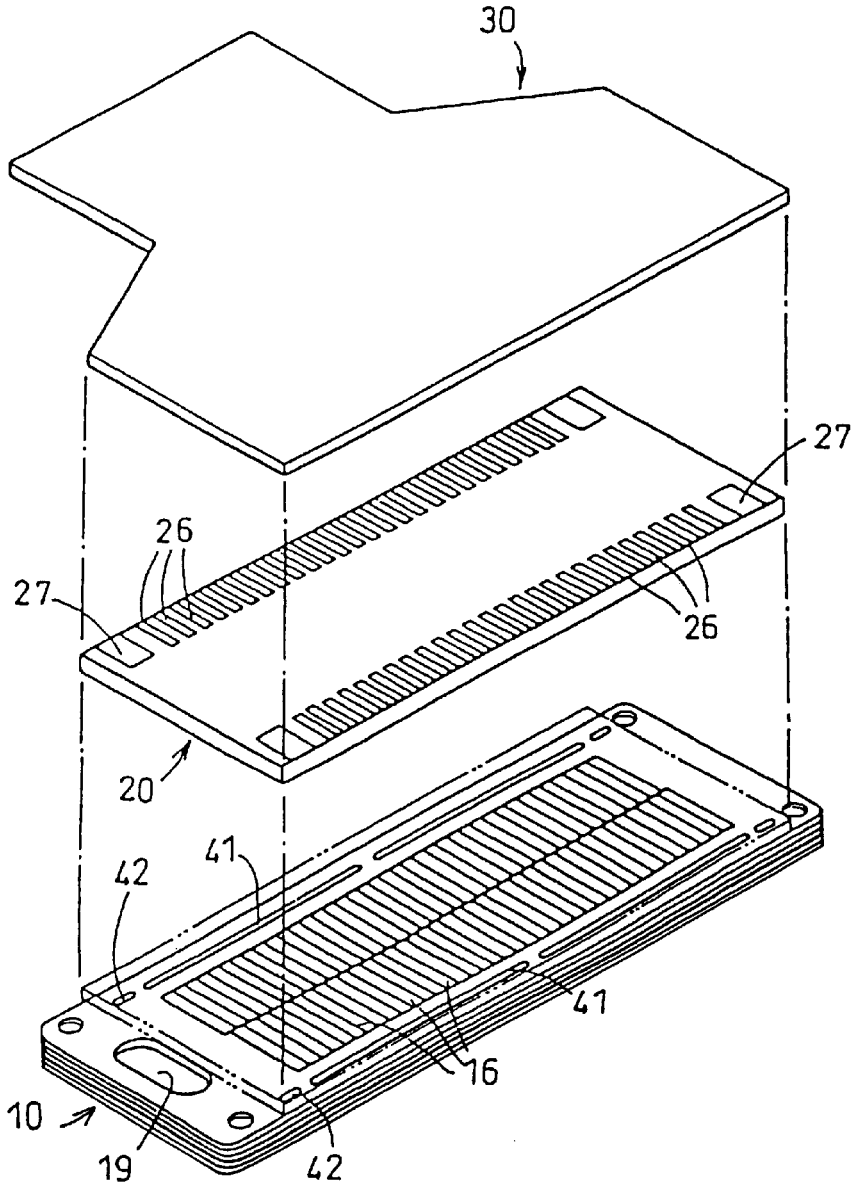
FIG. 1 is an exploded perspective view of part of an ink-jet head, which may be used in connection with the invention.
Figure 2A:
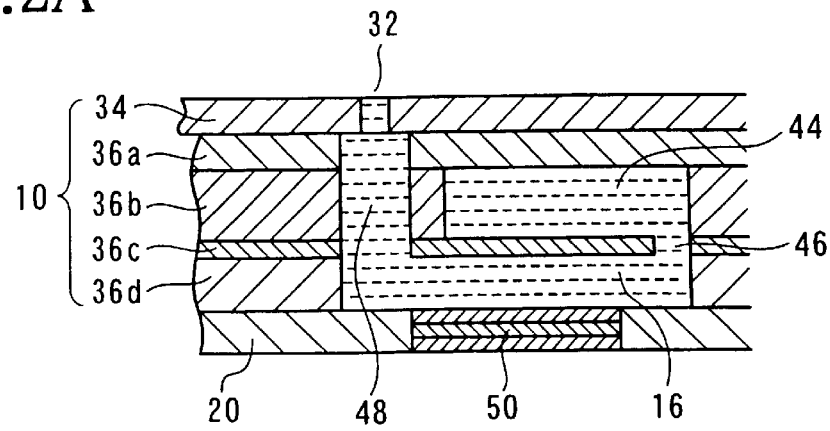
FIGS. 2A, 2B, and 2C are cross-sectional views showing ink ejection from the ink-jet head.
Figure 2B:
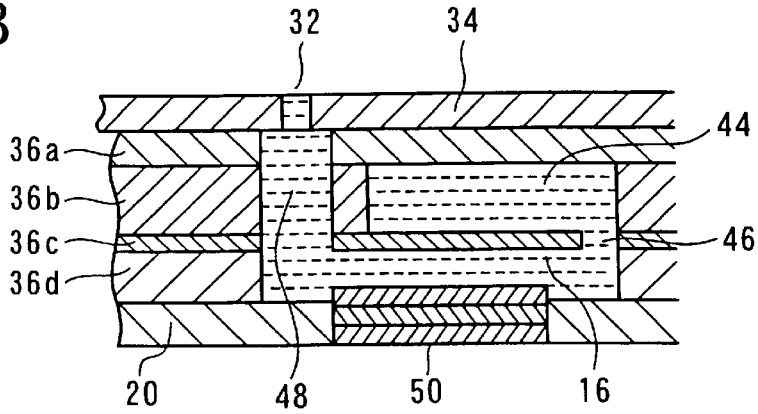
Figure 2C:
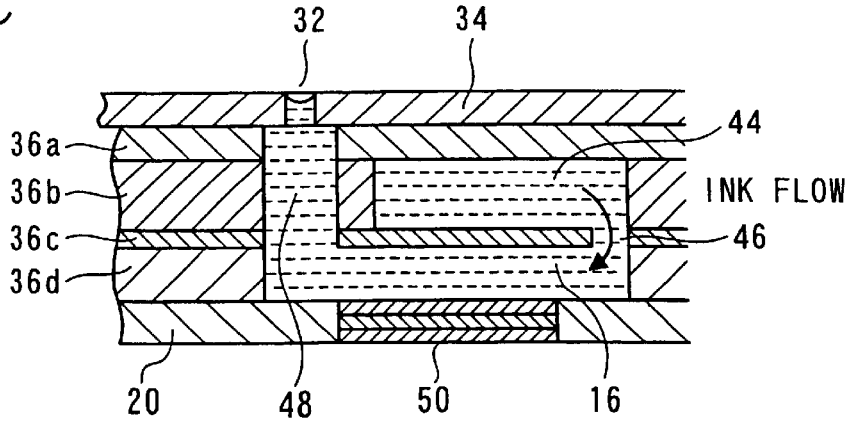
Figure 3A:
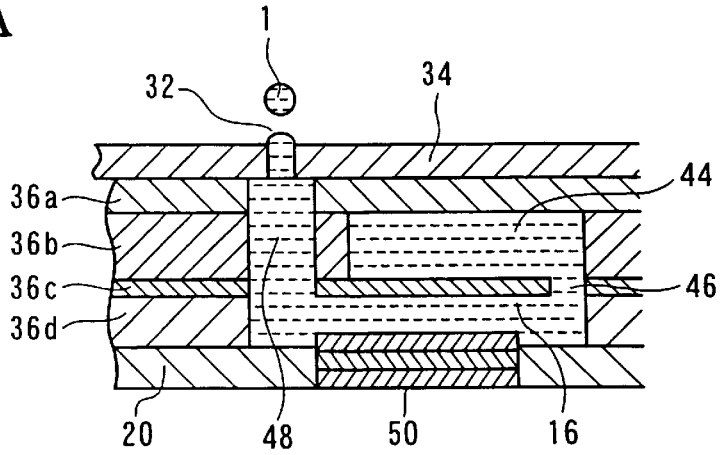
FIGS. 3A, 3B, and 3C are cross-sectional views showing ink ejection from the ink-ejection head.
Figure 3B:
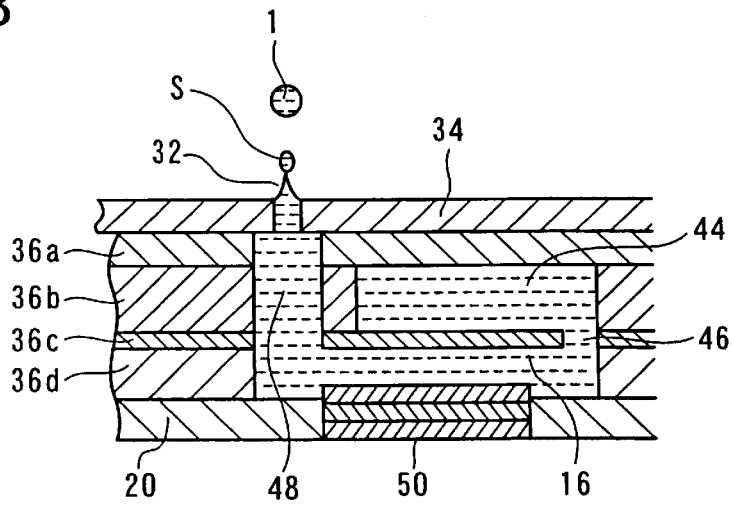
Figure 3C:
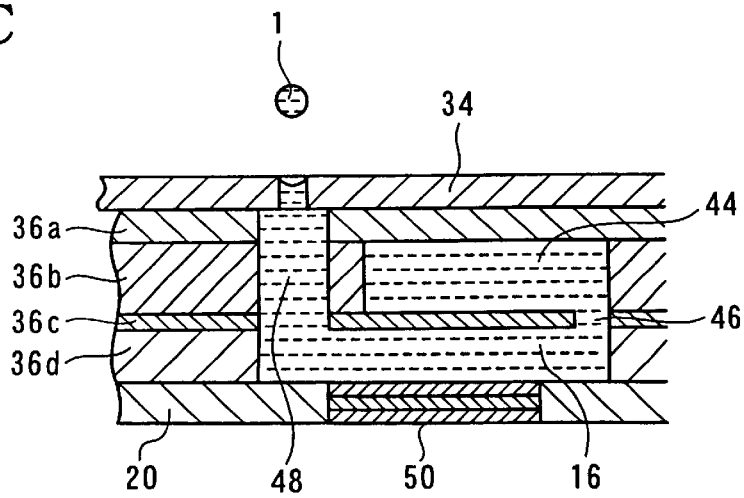
Figure 4:
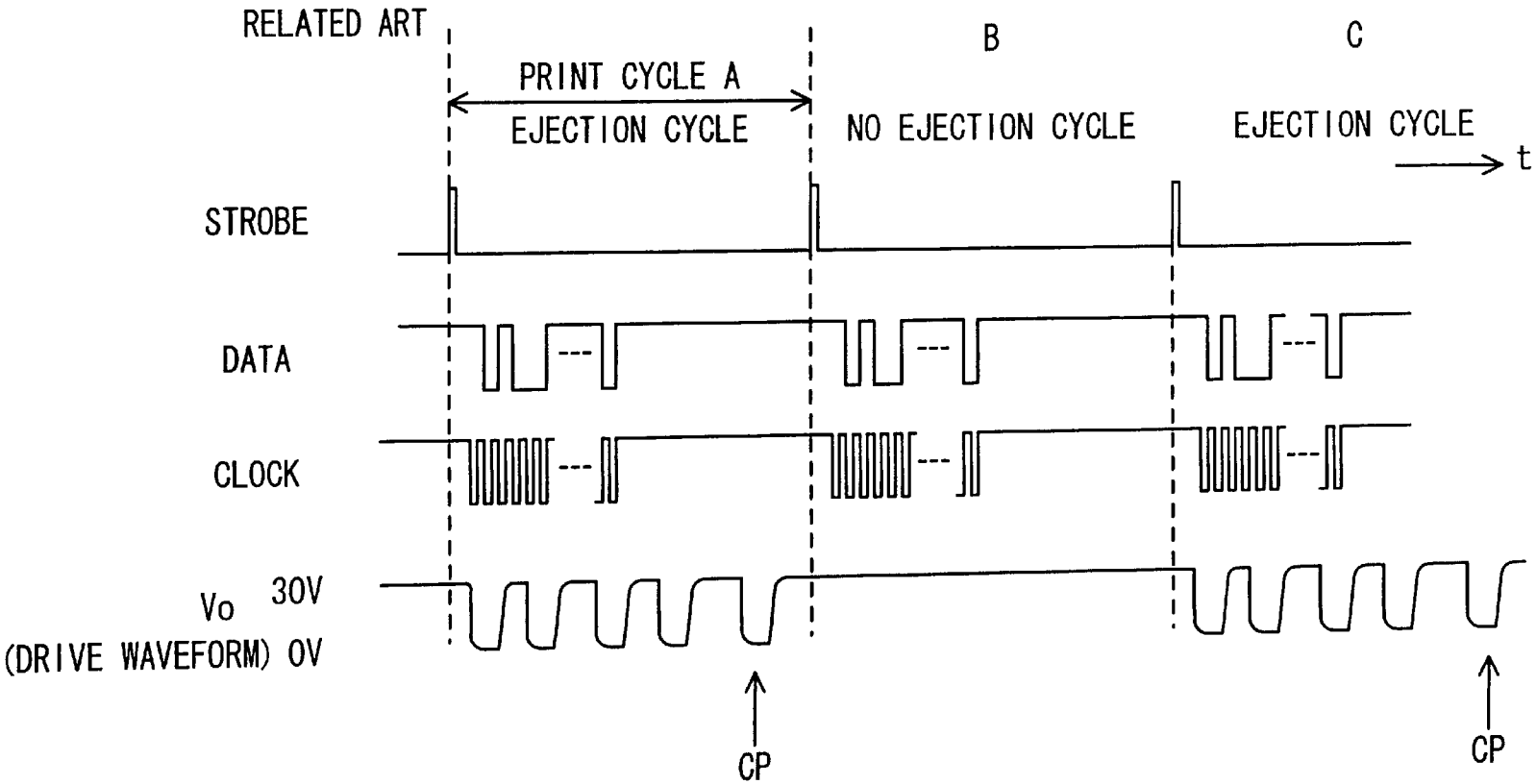
FIG. 4 is a timing chart showing generation of a drive waveform having a cancel pulse.
Figure 5:
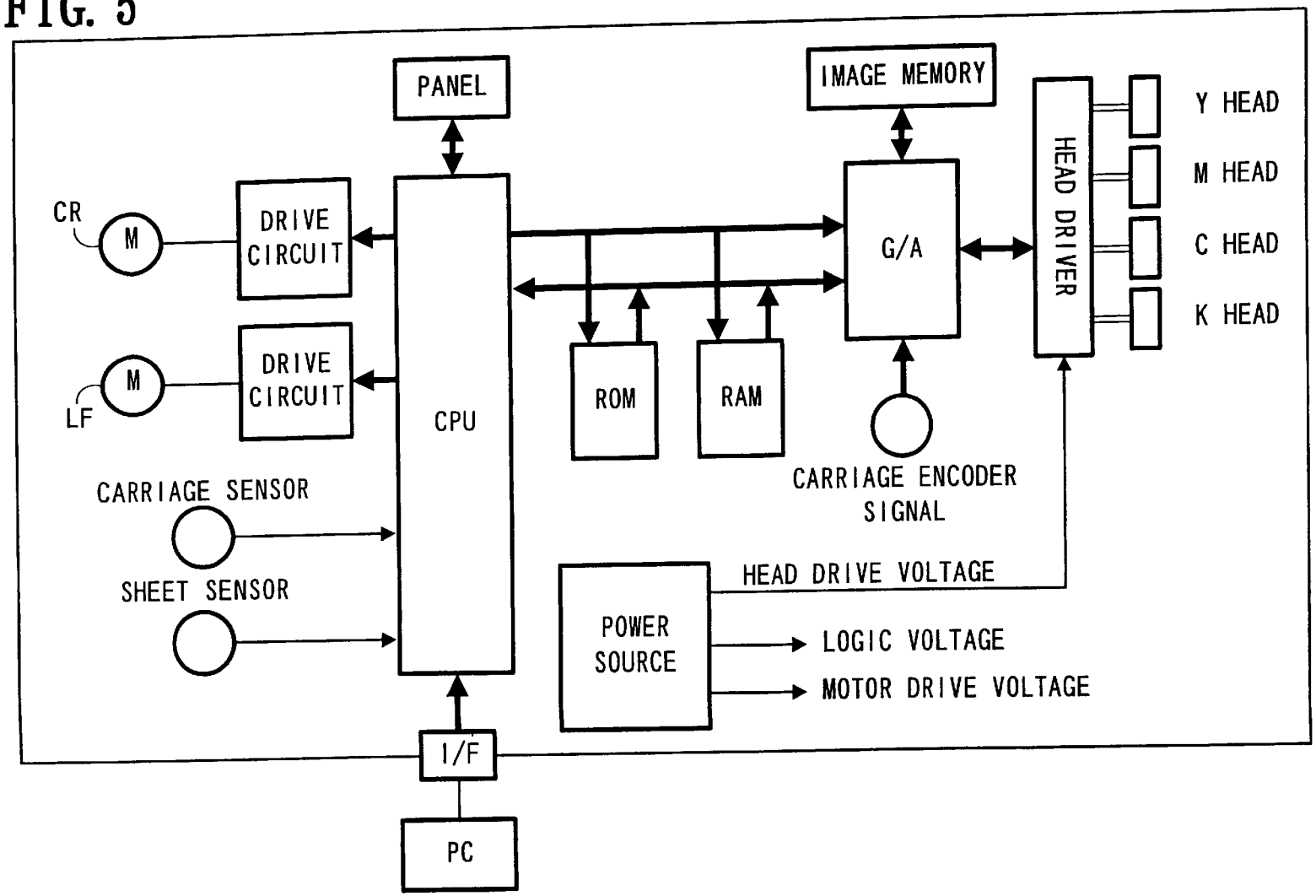
FIG. 5 is a block diagram showing substantial portions of an ink-jet printer, according to a first embodiment of the invention.

FIG. 5 is a block diagram of substantial portions of an ink-jet printer incorporating an ink-jet head controller constructed in accordance with the invention. The ink-jet printer includes a gate array circuit G/A that controls printing operations, such as print data processing, a CPU that entirely controls the printer, an interface I/F to which a computer system PC, such as a personal computer, is connected. The ink jet printer also includes an image memory that stores print data received from the computer system PC, a carriage motor CR and a sheet feed motor LF connected to the CPU via respective drive circuits, a carriage sensor that detects whether the carriage is at its initial position, a sheet sensor that detects whether a sheet is present at the print position and a carriage encoder that detects the carriage position. A ROM that stores various programs executed for printing and data transmission and data used for the programs is also included in the ink jet printer, as well as a RAM that temporarily stores data used for program execution, a head driver, 4-color ink-jet heads Y, M, C, K, a power source as a voltage source of a head drive voltage, a logic voltage, and a motor drive voltage.

Figure 6:
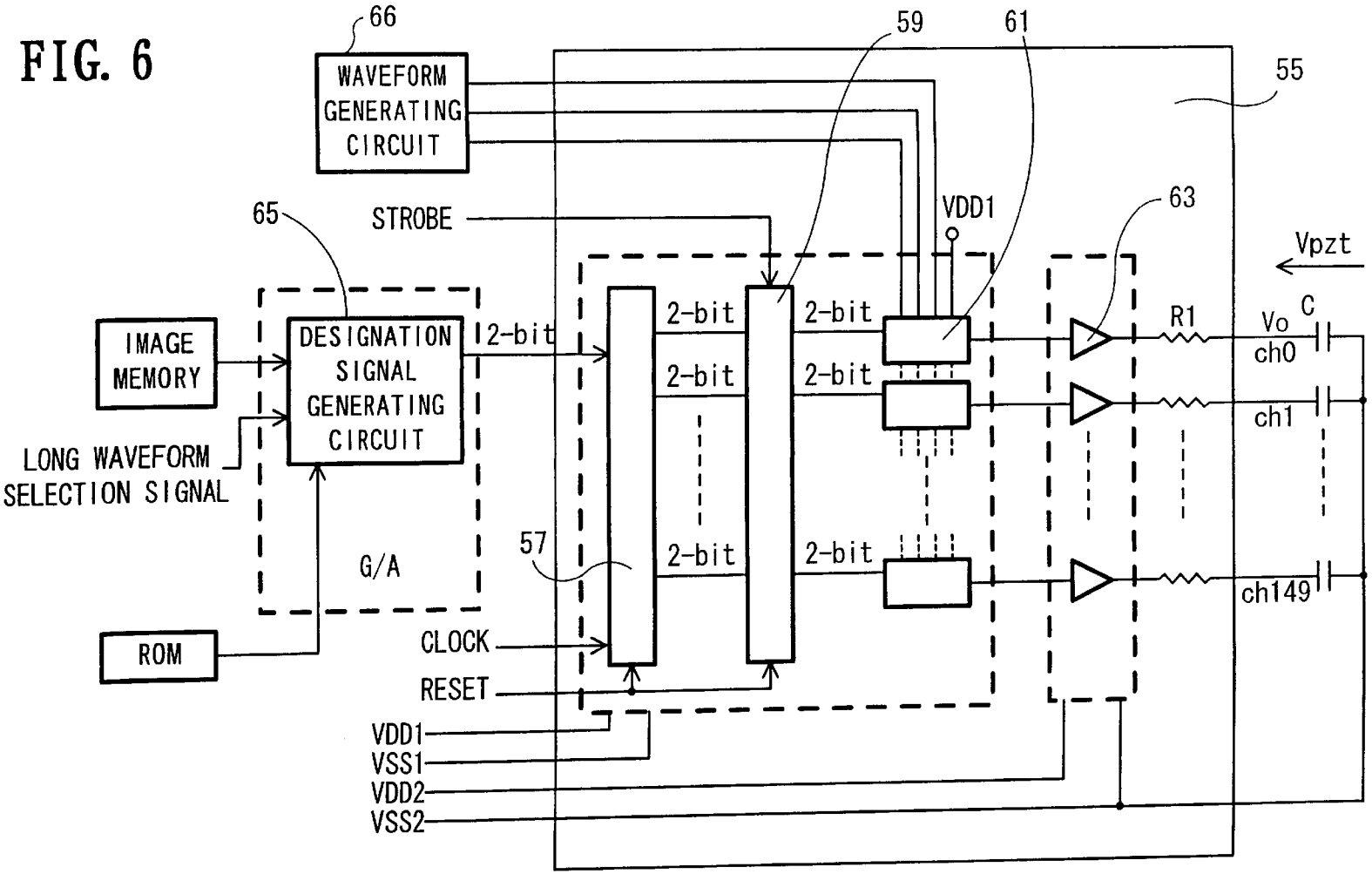
FIG. 6 is a block diagram showing a head driver and its peripherals, including a gate array, of an ink-jet head controller, according to the first embodiment of the invention.

The head driver 55 and its peripherals are shown in detail in FIG. 6. As shown in FIG. 6, the head driver 55 includes therein a shift register 57, a D flip-flop 59, multiplexers 61, and drivers 63. Each driver 63 is connected to a piezoelectric element C. A designation signal generating circuit 65 built in the gate array circuit G/A sequentially reads print data (dot data) stored in the image memory, and serially generates designation signals that designate the waveforms, based on the dot data and data in the ROM and the long waveform selection signal. The designation signals are 2-bit signals used to select one of four drive waveforms. The serially outputted designation signals are inputted to the shift register 57 and converted to parallel data corresponding to the number of nozzles of the ink-jet head. Then, the designation signals, as parallel data, are latched by the D flip-flop 59 and are outputted to each multiplexer 61 in synchronism with strobe signals. Meanwhile, three waveforms outputted from the waveform generating circuit 66 as well as another waveform representing a constant voltage VDD1 are inputted to each multiplexer 61. These four waveforms are shown in FIG. 7.

Figure 7:
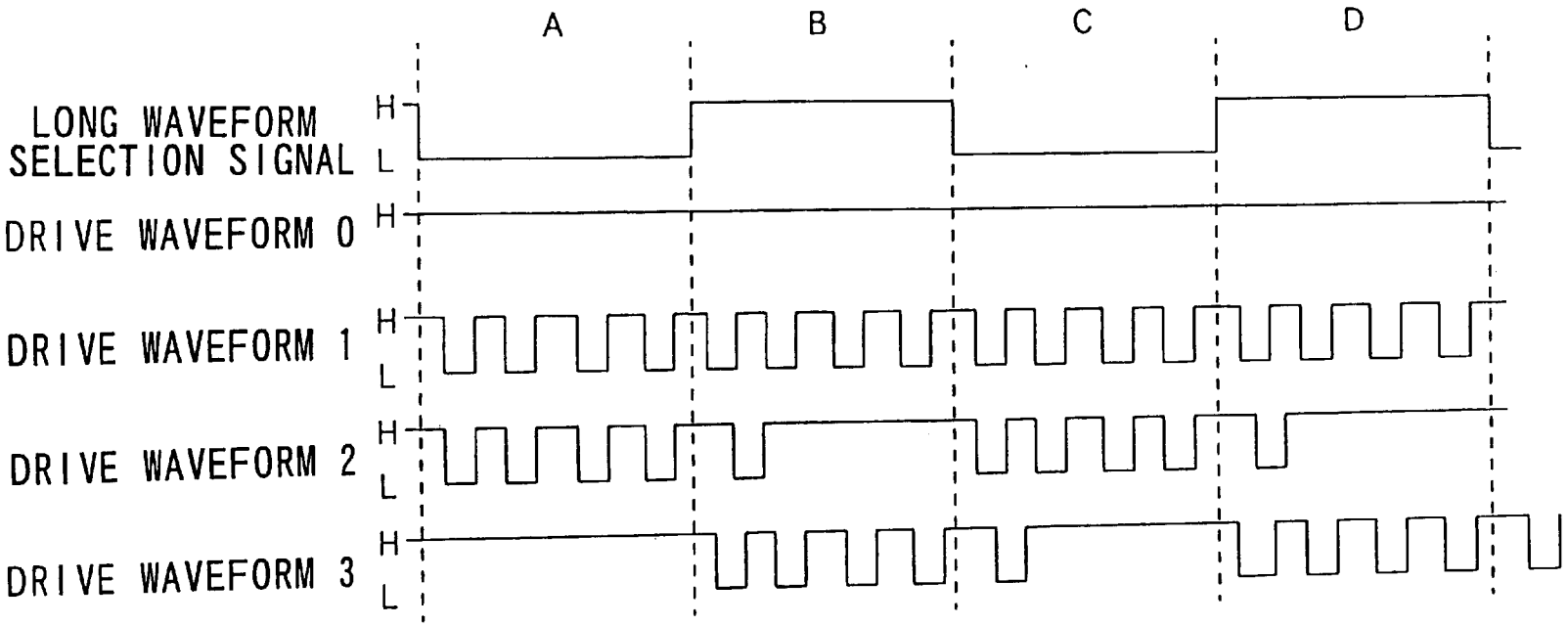
FIG. 7 is a timing chart showing four drive waveforms selectable in the ink-jet head controller and a long waveform selection signal, according to the first embodiment of the invention.

FIG. 7 is a timing chart showing the four waveforms, namely, drive waveform 0 (representing a voltage VDD1), drive waveform 1, drive waveform 2, drive waveform 3, and the long waveform selection signal. Each section indicated by A, B, C, and D is a print cycle. Drive waveform 1 is used to output a plurality of pulses within a print cycle to form a single dot. Drive waveforms 2 and 3 are used to output a plurality of pulses over two adjacent print cycles. Drive waveforms 2 and 3 have a plurality of ejection pulses that cause continuous ejection of a plurality of ink droplets, and a cancel pulse at the end that suppresses the pressure wave vibration in the cavity. Alternatively, drive waveforms 2 and 3 may have a cancel pulse in the middle of ejection pulses, or may have no cancel pulse at all. Drive waveforms 2 and 3 have the same pulse string but are shifted from each other by one print cycle, which is defined by a strobe signal.

The long waveform selection signal represents a signal alternating low and high voltages at each print cycle, as shown in FIG. 7, and is outputted by the CPU to the designation signal generating circuit 65.

The ROM stores the long waveform selection signal and a lookup table (TABLE 1) used to select a drive waveform used for the current dot, based on data on the previous, current, and next dots.

The designation signal generating circuit 65 stores data on the previous, current, and next dots, and refers to the lookup table and the long waveform selection signal in the ROM to output a number (0, 1, 2, or 3) that designates a drive waveform used for the current dot. Even when the current dot does not involve ink ejection, drive waveforms 3 or 2 are selected as a successive part of the drive waveforms 3 or 2 that had been selected for the previous dot.

TABLE 1

| LONG WAVEFORM SELECTION SIGNAL | PREVIOUS DOT | CURRENT DOT | NEXT DOT | DRIVE WAVEFORM SELECTION SIGNAL |
|---|---|---|---|---|
| L | x | EJECTION | NO EJECTION | 2 |
| L | x | EJECTION | EJECTION | 1 |
| L | NO EJECTION | NO EJECTION | x | 0 |
| L | EJECTION | NO EJECTION | x | 3 |
| H | x | EJECTION | NO EJECTION | 3 |
| H | x | EJECTION | EJECTION | 1 |
| H | NO EJECTION | NO EJECTION | x | 0 |
| H | EJECTION | NO EJECTION | x | 2 |

In TABLE 1, x indicates either ink ejection or no ink ejection. More particularly, when ink is ejected for the current dot, the drive waveform selection signal is selected depending on the ejection states of the current and next dots, regardless of the ejection state of the previous dot. In contrast, when no ink is ejected for the current dot, the drive waveform selection signal is selected depending on the ejection states of the current and previous dots, regardless of the ejection state of the next dot.

Figure 8:
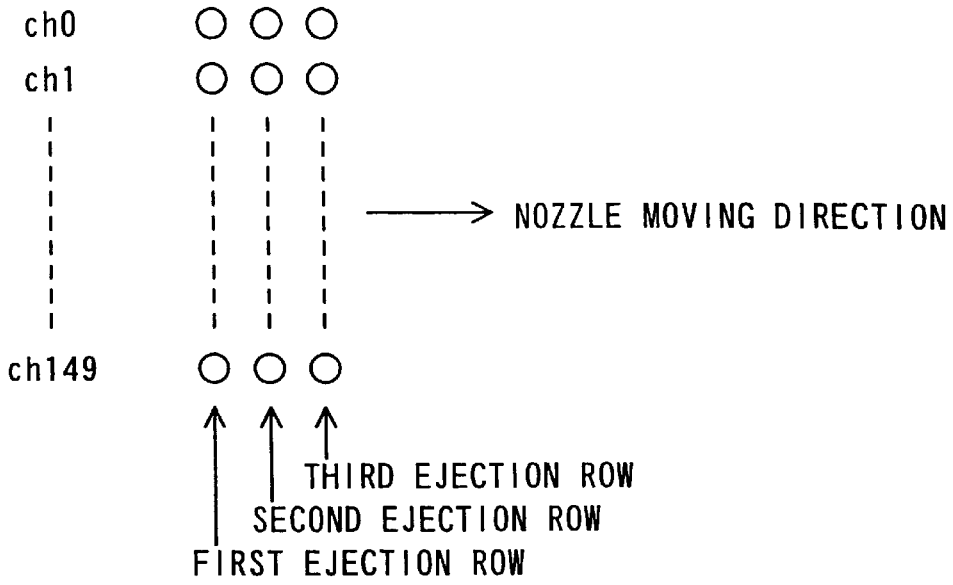
FIG. 8 is a diagram illustrating the concept of previous, current, and next dots used for waveform selection, according to the first embodiment of the invention.

FIG. 8 is a schematic diagram showing dot formation using 150 nozzles ch0, ch1, . . . , ch 49 provided for an ink-jet head. The 150 nozzles are aligned in a row, as described above, and mounted on the carriage. When the carriage moves perpendicular to the nozzle alignment direction, dots are formed on the sheet. The previous dot means a dot formed or not formed using the same nozzle when the carriage has been located at the immediately preceding print cycle, while the next dot means a dot to be formed or not to be formed using the same nozzle at the immediately following print cycle. For example, when dots in the second ejection row are assumed to be the current dots, dots in the first ejection row are defined as the previous dots, and dots in the third row are defined as the next dots.

In short, a number that designates a drive waveform used for the current dot is selected, as shown in TABLE 1, based on whether ink is ejected for the current dot and the previous or next dot and whether the current dot falls at an even- or odd-numbered print cycle. This lookup table is stored in the ROM. Which drive waveform each multiplexer 61 outputs in response to the output from the D flip-flop 59 is shown in TABLE 2.

TABLE 2

| INPUT TO MULTIPLEXER (OUTPUT FROM D FLIP-FLOP) | OUTPUT FROM MULTIPLEXER (INPUT TO DRIVER) |
|---|---|
| 0 | VDD1 |
| 1 | DRIVE WAVEFORM 1 |
| 2 | DRIVE WAVEFORM 2 |
| 3 | DRIVE WAVEFORM 3 |

As shown in TABLE 2, each multiplexer 61 outputs drive waveform 2 upon receipt of "2" from the D flip-flop 59.

Figure 9:
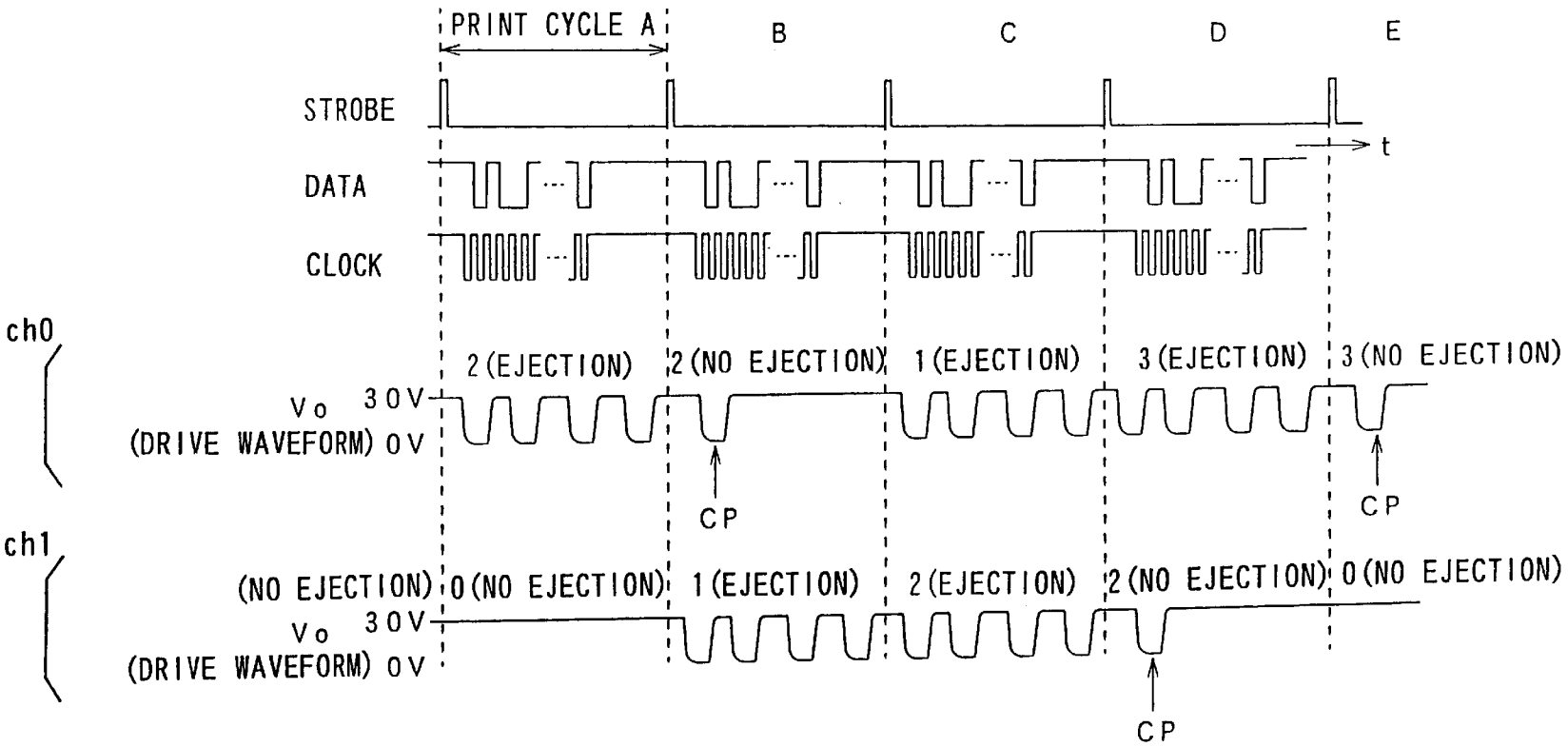
FIG. 9 is a timing chart showing drive waveforms used in the ink-jet head controller, according to the first embodiment of the invention.

FIG. 9 shows drive waveforms actually outputted based on the dot data. This figure shows an example where ink ejection and no ink ejection randomly occur from two nozzles ch0, ch1. As shown in TABLE 1, whenever ink ejection is followed by no ink ejection, drive waveform 2 or 3 having a cancel pulse CP are selected.

In FIG. 9, long waveform selection signals L and H are assigned to print cycles A and B, respectively, and long waveform selection signals L and H are alternately assigned to the following print cycles. In this case, the CPU outputs long waveform selection signal L to odd-numbered print cycles and long waveform selection signal H to even-numbered print cycles.

For example, with reference to print cycle D for nozzle ch0, the long waveform selection signal is H because print cycle D is an even-numbered print cycle, and ink is ejected for the current dot while no ink is ejected for the next dot (print cycle E). In this case, the designation signal generating circuit 65 refers to TABLE 1 stored in the ROM As described above, the designation signal generating circuit 65 selects drive waveform 2 or 3 appropriately, based on the long waveform selection signal indicating the ordinal position of a print cycle, in either case where a pattern of ink ejection followed by no ink ejection starts at an even-or odd-numbered print cycle. When ink is ejected at the next print cycle as at print cycle C for nozzle ch0 and at print cycle B for nozzle ch1, drive waveform 1 is selected to form a dot within a single current print cycle.

As described above, when a dot is formed by ink ejection followed by no ink ejection, a drive waveform extending over two adjacent print cycles is generated. Accordingly, the print cycle is not elongated and thus high-speed printing can be achieved.

Under control of the ink-jet head controller as described above, a drive waveform including a cancel pulse C extends over two adjacent print cycles. Thus, generation of a satellite droplet S or unstable ink ejection can be prevented even when the pressure wave vibration in the cavity 16 is increased. In addition, such a long drive waveform can be used without elongating the print cycle and, as a result, high-speed printing can be achieved. The ink-jet head controller according to the first embodiment of the invention can drive the ink-jet head appropriately based on the dot data associated with continuous print cycles. Additionally, each multiplexer 61 can readily select drive waveforms 2 or 3 according to the long waveform selection signal.

Each multiplexer 61 selects drive waveform 1 for the current print cycle when dot data for both current and next print cycles indicates ink ejection. Drive waveform 1 has drive pulses completed within a single print cycle and forming a dot equivalent in density to dots formed by drive waveforms 2 and 3. Thus, a dot can be formed appropriately within the current print cycle when ink is ejected continuously at the next print cycle.

In the above-described embodiment, a cancel pulse CP is inserted at the end of a drive waveform. However, it may be inserted in the middle of a drive waveform, or a plurality of cancel pulses PC may be inserted within a single drive waveform.

Although processing of gray-scale data has not been discussed, when the print density is low and a drive waveform including a cancel pulse CP does not extend beyond a single print cycle, the controller may be designed not to perform the above-described drive waveform selection.

Figure 10:
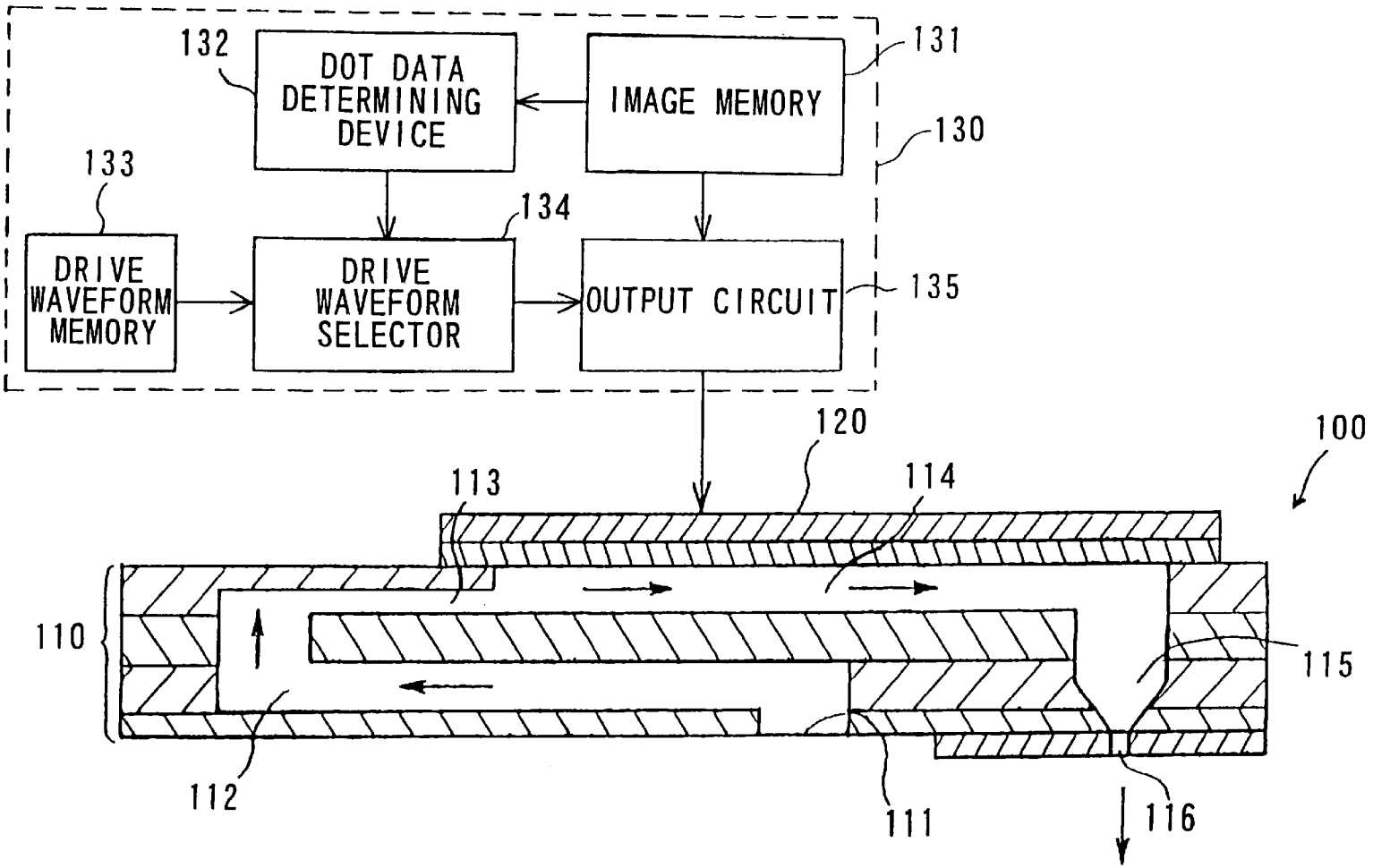
FIG. 10 is a cross-sectional view of an ink-jet head and a block diagram of a controller, according to a second embodiment of the invention.

FIG. 10 is a schematic diagram showing an ink-jet head 100 and a controller 130 according to the second embodiment of the invention. As illustrated, the ink-jet head 100 includes a cavity plate 110 and a piezoelectric actuator 120. A cavity plate 110 is formed with an ink supply port 111 connected to an ink source, a manifold 112, a restrictor groove 113, a cavity 114, a descender orifice 115, and a nozzle 116.

The cavity plate 110 is formed by laminating and bonding a plurality of steel plates each having a thickness of about 50–150 $\mu$m and alloyed with 42% nickel. Alternatively, the cavity plate 110 may be formed by resin plates.

The piezoelectric actuator 120 is formed by a piezoelectric sheet, an electrical insulating sheet, drive electrodes, and the like and is attached so as to cover open surfaces of the cavities 114 in the cavity plate 110.

The controller 130 includes an image memory 131 that stores externally inputted dot data to be printed. The controller 130 also includes a dot data determining device 132 that determines whether there is dot data for the current and next print cycles based on dot data stored in the image memory 131. A drive waveform memory 133 is included that stores a plurality of drive waveforms and a drive waveform selector 134 that selects a drive waveform from the drive waveform memory 133 based on the output from the dot data determining device 132 is also included. An output circuit 135 is provided that supplies a selected drive waveform representing the dot data read from the image memory 131 to the piezoelectric actuator 120 in synchronism with clock signals.

When the controller 130, as described above, supplies drive pluses selectively to the drive electrodes of the piezoelectric actuator 120, the piezoelectric sheet deforms in the laminating direction due to the piezoelectric effect. Then, the volumetric capacity of the cavity 114 is reduced by the pressure caused by such deformation. As a result, ink in the cavity 114 is ejected from the nozzle 116 as an ink droplet and a specified dot is printed. At this time, the ink passes, from the upstream, through the ink supply port 111, manifold 112, restrictor groove 113, cavity 114, descender orifice 115, and nozzle 116.

Figure 11:
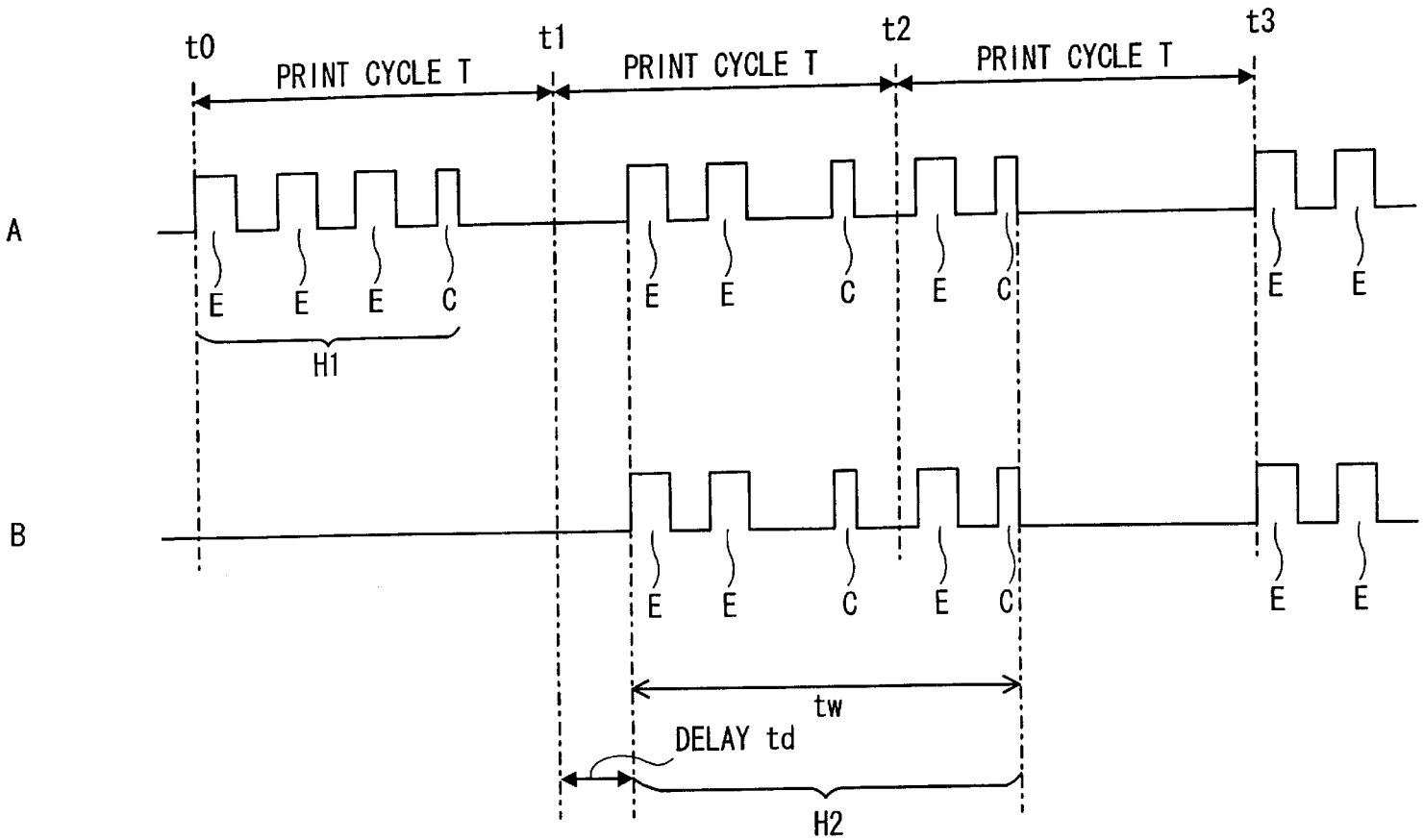
FIG. 11 shows drive waveforms outputted from the controller of FIG. 10.

FIG. 11 is an illustration of examples A and B of two waveforms H1, H2 used to control ink ejection. Waveforms H1 and H2 have the same number of ejection pulses for forming a dot. However, waveform H1 is a normal waveform to be outputted within a print cycle T, while waveform H2 is a long waveform to be outputted over two adjacent print cycles T, T. Waveforms H1 and H2 have three ink ejection pulses to be outputted to form a dot and these waveforms are stored in the drive waveform memory 133.

In example A of FIG. 11, waveform H1 is a normal waveform to be outputted at time t0 and has three ejection pulses and a cancel pulse. Waveform H2 is a long waveform to be outputted after a delay td from time t1 and has three ejection pulses and two cancel pulses. The total length of waveform H2 is greater than the print cycle T.

The long waveform H2 is effectively used to prevent generation of a satellite droplet when a dot is formed at the current print cycle and no dot will be formed at the next print cycle.

In example A of FIG. 11, a first dot is formed at the first print cycle T, which starts at time t0, a second dot starts being formed at the second print cycle T, which starts at time t1, and no dot starts being formed at the third print cycle T, which starts at time t2.

In example B of FIG. 11, there is no dot to be formed at the first print cycle T, which starts at time t0, a first dot starts being formed at the second print cycle T, which starts at time t1, and no dot starts being formed at the third print cycle T, which starts at t2.

In either example, because the total length of a drive waveform that starts being outputted at the second print cycle T is long, or because the output timing of that drive waveform is delayed, that drive waveform partially extends over the third print cycle T. Even if such a long and delayed drive waveform is generated, there is no drive waveform to be affected by such a drive waveform at the third print cycle T.

In the second embodiment of the invention, the above-described long waveform H2 is used when a dot is formed at the current print cycle and no dot will be formed at the next print cycle. In addition, the waveform H2 is adapted to be outputted after a delay td as compared with the normal waveform H1. As a result, a cancel pulse can be outputted in preferable timing. Furthermore, as shown in example A of FIG. 11, two cancel pulses can be outputted. Accordingly, when a plurality of ejection pulses are outputted to form a dot, the pressure wave vibration in the cavity 114 can be stabilized, and generation of a satellite droplet or unstable ink ejection can be reliably prevented.

In addition, because the long waveform H2 is outputted after a delay td as compared with the normal waveform H1, a cancel pulse can be added, as shown in example A of FIG. 11, to the drive waveform at the first print cycle T, which starts at time t0, when a dot is formed at the first cycle T and a dot will also be formed at the next print cycle. As a result, when a plurality of ejection pulses are outputted, the pressure wave vibration in the cavity 114 can be reliably stabilized.

Figure 12:
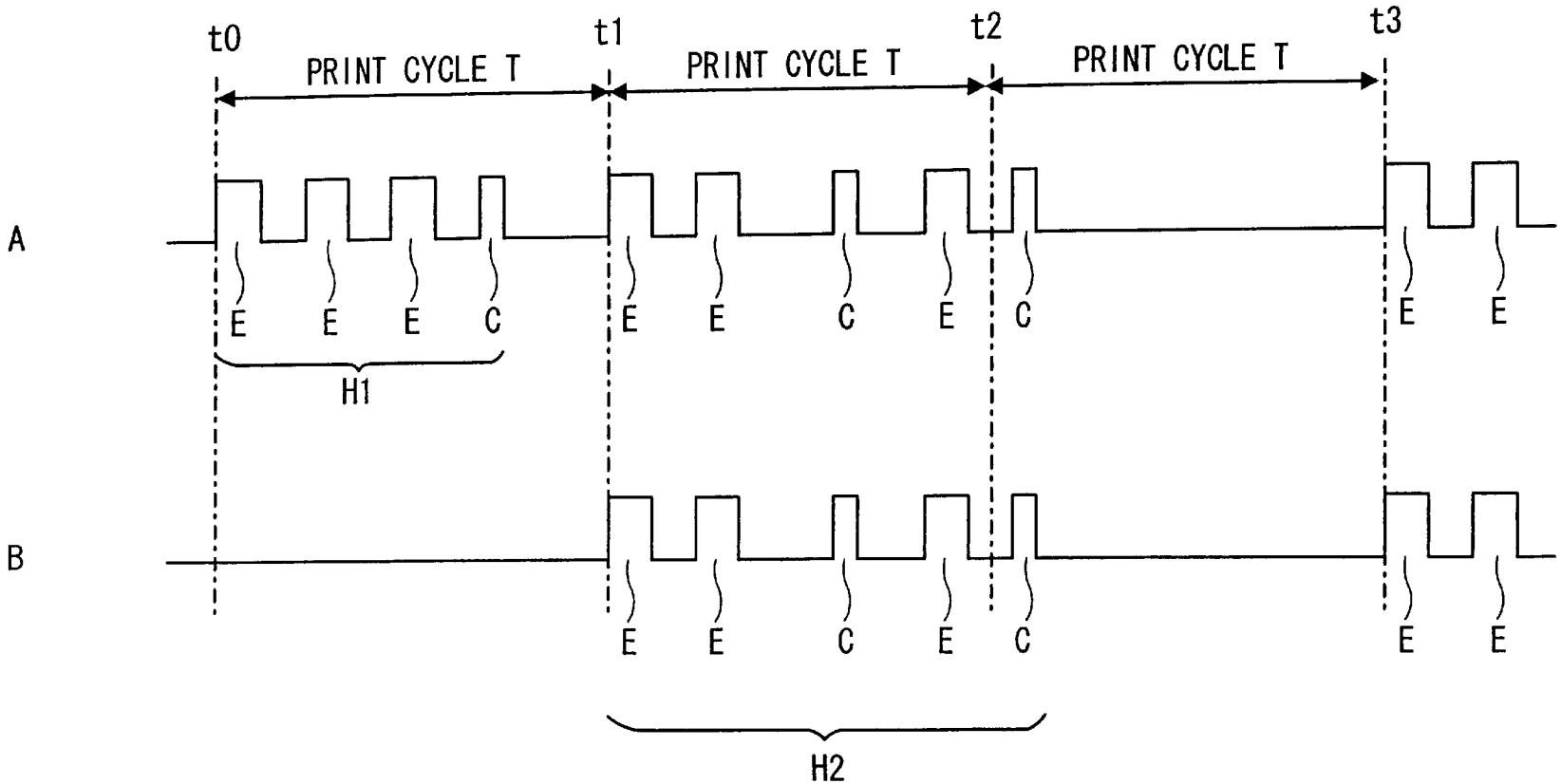
FIG. 12 shows other drive waveforms outputted from the controller of FIG. 10.

In contrast, when the long waveform H2 is outputted at time t1 as shown in example A of FIG. 12, the time interval between the cancel pulse outputted at the first print cycle T starting at time t0 and the first ejection pulse of the long waveform H2 is shortened. As a result, the residual pressure wave vibration in the cavity 14 cannot be attenuated in such a short interval, and ink ejection by the long waveform H2 becomes unstable.

As shown in example B of FIG. 12, when there is no drive waveform to be outputted at the first print cycle T starting at time t0, stable ink ejection can be achieved by the long waveform H2 to be outputted at time t1. In this case, even if the long waveform H2 is outputted after a delay td, as shown in example B of FIG. 11, the same result as in example B of FIG. 12 can be obtained. Thus, when a dot is formed at the current print cycle and no dot will be formed at the next print cycle, stable ink ejection can be achieved by simply providing a delay td at the current print cycle before outputting the long waveform H2, regardless of whether the previous dot has been formed.

In the above-described controller 130 for the ink-jet apparatus, a plurality of drive pulses are continuously outputted to eject a plurality of ink droplets to form a dot. When dot data for the current print cycle indicates ink ejection and when dot data for the next print cycle indicates no ink ejection, the controller 130 outputs a plurality of drive pulses after a certain delay from the start of the current print cycle. Under such control, the residual pressure wave vibration in the cavity 114 generated by a plurality of drive pulses can be attenuated and ink can be stably ejected. Also, generation of a satellite droplet can be reliably prevented.

In addition, in the above-described case, the controller 130 outputs a plurality of drive pulses after a certain delay from the start of the current print cycle such that a plurality of drive pulses extend over the current and next print cycles. Accordingly, even if a plurality of pulses, which are outputted after a certain delay, constitutes a long drive waveform, such a long drive waveform can be outputted without causing elongation of the print cycle.

Further, a plurality of drive pulses includes a cancel pulse for attenuating the pressure wave vibration in the cavity 114. Accordingly, the pressure wave vibration in the cavity 114, caused by continuous output of a plurality of drive pulses, can be stabilized. Additionally, when dot data for the current print cycle indicates ink ejection and dot data for the next print cycle indicates no ink ejection, a plurality of drive pulses are outputted after a certain delay at the current print cycle. Such a delay provides enough time for the pressure wave vibration in the cavity 114, caused by the output of drive pulses including a cancel pulse at the previous print cycle, to be reduced. Thus, the pressure wave vibration in the cavity 114 can be reliably stabilized.

Although the second embodiment has been described with reference to examples where two waveforms, namely, a normal waveform to be outputted within a print cycle and a long waveform to be outputted over two adjacent print cycles, are used, the invention is not limited to these examples. For example, two drive waveforms, both of which are outputted within a print cycle, but one of which has a single cancel pulse and the other of which has two cancel pulses, may be used. When a dot is formed at the current print cycle and no dot will be formed at the next print cycle, a drive waveform having two cancel pulses may be outputted after a delay td at the current print cycle.

An optimum value for the length of a delay td may be selected based on the size or shape of the cavity 114, or based on the ambient temperature of the ink-jet head 100.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. A controller for an ink-jet apparatus having an ink-jet head that ejects ink from a cavity, the controller comprising:

a waveform generator that generates a plurality of waveform signals to be issued at predetermined print cycles to the ink-jet head, which forms dots sequentially according to the plurality of waveform signals on a print medium while the ink-jet head moves relative to the print medium, the plurality of waveform signals including a waveform signal extending over two adjacent print cycles and a waveform signal completing within a print cycle; and a waveform selector that receives the plurality of a waveform signals from the waveform generator and selects one of the plurality of waveform signals from the received plurality of waveform signals based on whether dot data for two adjacent print cycles indicates ink ejection, and outputs a selected waveform signal to the ink-jet head, the waveform selector selecting the waveform signal extending over two adjacent print cycles when the dot data for a current print cycle indicates ink ejection while the dot data for a next print cycle indicates no ink ejection, and the waveform selector selecting the waveform signal completing within a print cycle for the current print cycle when the dot data for both current and next print cycles indicates ink ejection.

2. The controller according to claim 1, wherein the waveform signal extending over two adjacent print cycles includes a cancel pulse that reduces pressure wave vibration in the cavity.

3. The controller according to claim 2, wherein the waveform generator generates a first waveform signal extending over two adjacent print cycles and a second waveform signal that is identical in pulse string with the first waveform signal but shifted from the first waveform signal by one print cycle, and wherein the waveform selector selects one of the first and second waveform signals, based on whether the dot data for the current and next print cycles indicates ink ejection and based on an ordinal position of the current print cycle.

4. The controller according to claim 3, further comprising a waveform selection signal generator that generates a signal changing, in status, alternately at each print cycle to indicate the ordinal position of each print cycle, wherein the waveform selector outputs one of the first and second waveform signals to the ink-jet head, based on the signal generated by the waveform selection signal generator.

5. The controller according to claim 4, wherein the waveform selector includes:

a designation signal generator that generates a designation signal designating a waveform signal, based on whether the dot data for the current and next print cycles indicates ink ejection and based on the ordinal position of the current print cycle; and a designation signal selector that selects, based on the designation signal, one of the plurality of waveform signals generated by the waveform generator.

6. The controller according to claim 3, wherein the waveform generator generates the waveform signal completing within a print cycle as a third waveform signal, and a dot formed according to the third signal is equivalent in density to dots formed according to the first and second waveform signals.

7. The controller according to claim 1, wherein the waveform signal extending over two adjacent print cycles includes a plurality of drive pulses that cause ejection of a plurality of ink droplets to form a dot.

8. An ink-jet apparatus that sequentially forms dots on a print medium by moving relative to the print medium, the ink-jet apparatus comprising:

a cavity plate having a cavity from which an ink droplet is ejected;

an actuator that changes a pressure in the cavity; and a controller that outputs drive pulses, at predetermined print cycles, to the actuator based on dot data, wherein when dot data for a current print cycle indicates ink ejection while dot data for a next print cycle indicates no ink ejection, the controller continuously outputs a plurality of drive pulses, over the current and next print cycles, after a certain delay from a start of the current print cycle, to the actuator to cause ejection of a plurality of ink droplets from the cavity to form a dot.

9. The ink-jet apparatus according to claim 8, wherein the plurality of drive pulses includes a cancel pulse that reduces pressure wave vibration in the cavity.

10. The ink-jet apparatus according to claim 8, wherein the controller continuously outputs a plurality of drive pulses completing within a print cycle for the current print cycle when the dot data for both current and next print cycles indicates ink ejection.

11. An ink-jet apparatus, comprising:

a cavity plate having a cavity from which an ink droplet is ejected;

an actuator that changes a pressure in the cavity; and a controller comprising:

a waveform generator that generates a plurality of waveform signals to be issued at predetermined print cycles to the actuator such that the ink-jet apparatus forms dots sequentially according to the plurality of waveform signals on a print medium while the ink-jet apparatus moves relative to the print medium, the plurality of waveform signals including a waveform signal extending over two adjacent print cycles and a waveform signal completing within a print cycle; and a waveform selector that receives the plurality of waveform signals from the waveform generator and selects one of the plurality of waveform signals from the received plurality of waveform signals based on whether dot data for two adjacent print cycles indicates ink ejection, and outputs a selected waveform signal to the actuator, the waveform selector selecting the waveform signal extending over two adjacent print cycles when the dot data for a current print cycle indicates ink ejection while the dot data for a next print cycle indicates no ink ejection and the waveform selector selecting the waveform signal completing within a print cycle for the current print cycle when the dot data for both current and next print cycles indicates ink ejection.

12. An ink-jet apparatus that sequentially forms dots on a print medium by moving relative to the print medium, the ink-jet apparatus comprising:

a cavity plate having a cavity from which an ink droplet is ejected;

an actuator that changes a pressure in the cavity; and a controller that outputs drive pulses, at predetermined print cycles, to the actuator based on dot data, wherein when dot data for a current print cycle indicates ink ejection while dot data for a next print cycle indicates no ink ejection, the controller continuously outputs a plurality of drive pulses, after a certain delay from a start of the current print cycle, to the actuator to cause ejection of a plurality of ink droplets from the cavity to form a dot, and when the dot data for both current and next print cycles indicate ink ejection, the controller continuously outputs a plurality of drive pulses without a delay from the start of the current print cycle.

13. The ink-jet apparatus according to claim 12, wherein the plurality of drive pulses outputted after the certain delay extend over the current and next print cycles.

14. The ink-jet apparatus according to claim 13, wherein the plurality of drive pulses outputted after the certain delay include a cancel pulse that reduces pressure wave vibration in the cavity.

* * * * *